United States Patent [19]

Nihyakumen et al.

[11] 3,948,661

[45] *Apr. 6, 1976

[54] PROCESS FOR DIAZO-TYPE MULTICOLOR REPRODUCTION

[75] Inventors: Kouzi Nihyakumen, Hirakata; Taizo Yokoyama, Osaka; Yasuo Ueda, Kitano; Yasutcki Kamezawa, Osaka; Tatsuo Aizawa, Kuwata, all of Japan

[73] Assignee: Mita Industrial Company Ltd., Osaka, Japan

[ * ] Notice: The portion of the term of this patent subsequent to Mar. 13, 1990, has been disclaimed.

[22] Filed: Sept. 30, 1974

[21] Appl. No.: 510,693

Related U.S. Application Data

[63] Continuation of Ser. No. 308,502, Nov. 21, 1972, abandoned, which is a continuation-in-part of Ser. No. 12,049, Feb. 17, 1970, Pat. No. 3,715,213.

[52] U.S. Cl. ..... 96/49; 96/91 R; 427/261

[51] Int. Cl.[2]... G03C 1/58; G03C 1/52; B41M 5/00

[58] Field of Search..... 96/49, 75, 91 R; 250/65 T; 427/261

[56] References Cited

UNITED STATES PATENTS 3,715,213 2/1973 Nihyakumen et al..... 96/91 R

FOREIGN PATENTS OR APPLICATIONS 2,007,690 10/1970 Germany..... 96/91 R

OTHER PUBLICATIONS

Yerry, H. R., "Document Copying & Reproduction Processes," Fountain Press, London, 1958 (pp. 28–29 & 51–53).

*Primary Examiner*—David Klein
*Assistant Examiner*—L. V. Falasco
*Attorney, Agent, or Firm*—Sherman & Shalloway

[57] ABSTRACT

A process for diazo-type multi-color reproduction by which portions of a sensitive paper corresponding to predetermined portions of an original can be colored selectively to different hues by disposing a layer of thermotransferable coupler between an original and diazophotosensitive paper followed by exposure to light and heating of the assembly. The layer of thermotransferable coupler is not applied to the entire image area of the original and the thermotransferable coupler is faster in coupling rate with the diazonium salt under the development conditions than the basic color coupler of the photosensitive paper or developing solution.

9 Claims, 12 Drawing Figures

PROCESS FOR DIAZO-TYPE MULTICOLOR REPRODUCTION

Figure 1:
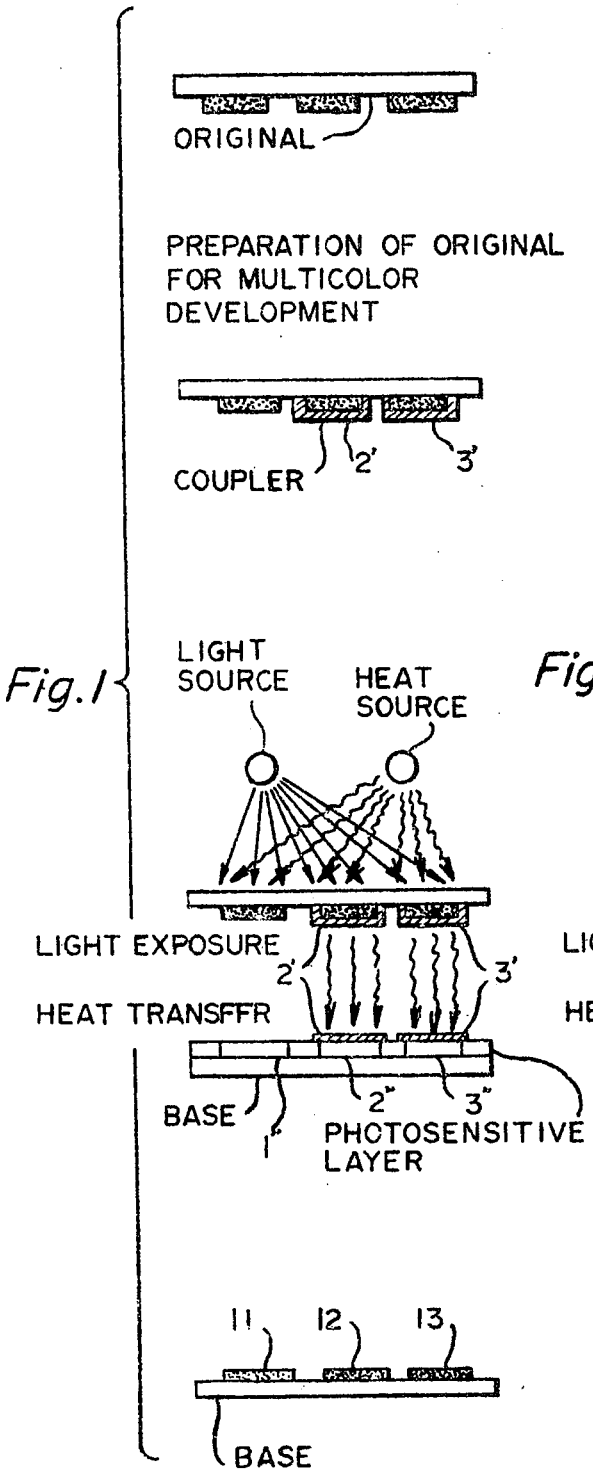

This is a continuation, of Application Ser. No. 308,502, filed Nov. 21, 1972, now abandoned, which is itself a continuation-in part of Application Ser. No. 12,049 filed Feb. 17, 1970, now U.S. Pat. No. 3,715,213.

This invention relates to a process for the diazo-type multicolor reproduction. More particularly, the invention relates to a process for diazo-type multicolor reproduction by which portions of a sensitive paper corresponding to predetermined portions of an original can be colored selectively to different hues.

It has heretofore been known that when two or more diazonium salts which have different resolving rates and exhibit different hues upon bonding with couplers are used in diazo-type reproduction, reproductive copies can be obtained which are colored in two or more hues depending on the intensity of light on the exposed portions. In such reproductive copies, image colors of the semi-exposed portions are mingled with image colors of non-exposed portions to form a compound color, and the color contrast in the image becomes faded. Further, in such known reproduction process it is impossible to reproduce an original having a similar image concentration or light transmission throughout the entire original, into different hues.

No diazo-type reproduction process has been known by which predetermined portions of an original can be reproduced into hues different from one another regardless of difference or similarity of the light transmission in the original.

It has now been found that predetermined portions of an original sheet can be reproduced into different hues regardless of the difference or similarity of the light transmission in the original by conducting the steps of (A) exposing to light a diazo-type photosensitive material containing at least one diazonium salt and (B) heating a layer of at least one thermovolatile or thermosublimable azo coupler (a) disposed in face-to-face contact with a predetermined portion of the diazo-type photosensitive material the, steps being carried out coincidentally or in an order of (A) to (B) or (B) to (A), and then developing the exposed photosensitive material in the presence of an azo coupler (b) having a lower coupling rate under developing conditions then the thermovolatile or thermosublimable coupler (a).

It is essential that among the thermovolatile or thermosublimable coupler (a), coupler (b) and diazonium salt (c) used in this invention the following relations should be established:

I. Thermovolatile or thermosublimable coupler (a) has a higher coupling rate under the developing conditions than coupler (b).

II. Dyestuff (b)-(c), dyestuff (a)-(c), dyestuff (a')-(c) .....formed by the development have hues different from one another.

Any coupler that can be volatilized or sublimated by heating and be coupled with a photosensitive diazonium salt may be used as the thermovolatile or thermosublimable coupler (a) in this invention. As such coupler (a) phenol derivatives, hydroxynaphthalene derivatives, aniline derivatives and active methylene group-containing compounds may be mentioned. They may be used singly, or two or more of them may be used in combination. It is generally preferred that these derivatives do not contain soluble groups such as a sulfonic acid group for the purpose of facilitating the heat transfer operation.

Examples of these derivatives usable as coupler (a) are as follows:

Phenol Derivatives

Phenol
Pyrocatechol
Resorcin
Phloroglycinol
o-Hydroxybenzalcohol
Resorcin monoglycol ether
Resorcin glycol ether
Hydrotoluquinone
Pyrogallol-4-carboxylic acid
Vanillin
Isovanillic acid
Vanillic acid
5-Hydroxy-isophthalic acid
2-Hydroxy-terephthalic acid
2-Hydroxy-p-toluylic acid
3-Hydroxy-p-toluylic acid
5-Hydroxy-o-toluylic acid
6-Hydroxy-m-toluylic acid
5-Hydroxy-1-naphthonic acid
Para-hydroxyphenylacetic acid
Para-hydroxybenzaldehyde
Ortho-hydroxybenzoic acid
Ortho-hydroxybenzyl alcohol
4,4-Dihydroxybiphenol
3,5-Dichloro-salicylic acid
5-Chloro-2-nitrophenol
2,5-Dihydroxyacetophenone
2,5-Dinitrophenol
2,4-Dinitrophenol
2,4-Dinitroresorcin
4,6-Dibromo-2-nitrophenol
2,5-Dimethyl hydroquinone Hydroxynaphthalene Derivatives 2,3-Dihydroxynaphthalene
β-Naphthol
α-Naphthol
1,6-Dihydroxynaphthalene
2,6-Dihydroxynaphthelene
2,7-Dihydroxynaphthalene
8-Amino-2-naphthol
2,2'-Dihydroxy-1,1'-binaphthyl
4,4'-Dihydroxy-1,1'-binaphthyl
3-Carboxy-2-naphthol Aniline Derivatives Meta-aminobenzoic acid
2-Amino-p-cresol
Ortho-aminophenol
Para-aminophenol
Para-chloroaniline
3,4-Diaminotoluene Active Methylene Group-Containing Compounds 1-Phenyl-3-methylpyrazolone (5)
1-Phenyl-3-carboxypyrazolone
Acetoacetic acid anilide
Acetoacetic-o-chloroanilide As coupler (b) to be used in combination with the above-mentioned coupler (a) in conducting the process of this invention, any coupler may be used as long as it has a lower coupling rate under the same developing conditions than the coupler (a) which is used. When a plurality of thermovolatile or thermosublimative couplers (a) are used, the coupling rate of coupler (b) should be lower than that of any of couplers (a). Selection of couplers (a) and (b) meeting the above requirement may be easily performed by those skilled in the art based on a simple experiment.

In addition to those having relatively low coupling rates among the above exemplified couplers, the following compounds may be used as coupler (b):

Phenol Derivatives 2,5,6-Trimethylphenol
2-Hydroxymethylphenol
β-(2-Hydroxyphenyl)-propionic acid
2-(ω-Phenylaminomethyl)-phenol
β-(4-Methyl-2-hydroxyphenyl)-glutaric acid
2,5-Dimethyl-6-(N-dimethylaminomethyl)-phenol
1,3-Dimethyl ether of pyrogallol
N-Lauryl-p-aminophenol
N-Acyl-m-aminophenol
Meta-hydroxy-acetoanilide
Ortho-N-hydroxyphenyl-monoguanidine
Para-N-hydroxyphenyl-biguanidine
2,5-Dimethyl-4-morpholinomethyl phenol
2-Methyl-5-isopropyl-morpholinomethyl phenol
4-Morpholinomethylresorcinol monomethyl ether
3,3′,5-Trihydroxydiphenyl
3,3′,5,5′-Tetrahydroxydiphenyl
2,2′,4,4′-Tetrahydroxydiphenyl,
2,4,4′-Trihydroxydiphenyl-2′-sulfonic acid
2,4,6,3′,5′-Pentahydroxydiphenyl
2,2′,4,4′-Tetrahydroxydiphenyl sulfide Naphthols 2,3-Dihydroxynaphthalene-6-sulfonic acid
2-Naphthol-3,6-Disulfonic acid
2,7-Dihydroxynaphthalene-3-sulfonic acid
2,8-Dihydroxynaphthalene-6-sulfonic acid
1,8-Dihydroxynaphthalene- 8-sulfonic acid
1-8-Aminonaphthol-5-sulfonic acid
2,7-Dihydroxy-3,6-disulfonic acid
1,8-Benzoylaminonaphthol-2-sulfonic acid
1,8-Dihydroxynaphthalene-6-sulfonic acid
2-Hydroxy-3-naphthionic-N-β-hydroxyethyl amide
2-Hydroxy-3-naphthionic-N,N-bis-β-hydroxylether amide
8-Hydroxy-2-naphthionic-hydroxyethyl amide
1-(N-Carboethoxymethylamino)-8naphthol-4-sulfonic acid
5-(Para-nitro)-benzamido-1-naphthol
1-Hydroxynaphthyl-7-phenyl-guanidine
2-Hydroxynaphthyl-8-biguanidine
1-Naphthol-3-(N-β-hydroxyethyl)-sulfonic amide
1-Naphthol-3-(N-o-methoxyphenyl)-sulfonic amide
Bis-[5-hydroxy-7-sulfo-naphthyl(2)]-amine
N,N-Bis[1-hydroxy-3-sulfo-naphthyl(6)]thiourea Active Methylene Group-Containing Compounds Acetoacetic acid cyclohexylamide
Acetoacetic acid benzylamide
Cyanoacetoanilide
Cyanoacetomorpholine Heterocyclic Compounds 1-(3′-Sulfoamide)-phenyl-3-methylpyrazolone-5
1-(4′-Carboxy-ethylphenyl)-3-dodecyl-pyrazolone-5

8-Hydroxy-1,2-naphthylimidazole
2-Methyl-4-hydroxybenzimidazole
7-Methyl-4-hydroxybenzothiazole
1,7-Dimethyl-4-hydroxy-benzotriazole
3-Hydroxythiophene-5-carboxylic acid
1-3-4-Cyclopentatrione In conducting the process of this invention, an original sheet for multicolor development is first formed by applying at least one transparent or semi-transparent layer containing a thermovolatile or thermosublimable coupler (a) onto the surface of one or more predetermined portions of a transparent or semi-transparent original sheet.

At this time the original sheet can have opaque image areas on at least one surface, namely on one or both surfaces thereof. The layer containing a thermovolatile or thermosublimable coupler (a) can be applied to only one surface of the original sheet. When the original sheet has opaque image areas only on one surface thereof, the layer containing coupler (a) is located only on the surface of the preselected image among image areas, and when the original sheet has image areas on both surfaces thereof, the layer containing coupler (a) can be located only on preselected areas which are either or both the image areas on one surface of the original sheet and areas contiguous with the image areas on the opposite surface of the original sheet. In the present specification, the surface to which the layer containing a thermovolatile or thermosublimable coupler (a) is applied is hereinafter called "coupler-applied surface."

The so formed original sheet for multicolor development is superposed on a diazo-type photosensitive material containing at least one diazonium compound (c) in a manner such that the layer of coupler (a) will confront the photosensitive surface of the photosensitive material, and the light-exposure and heating are effected coincidentally with the above superposition or after such superposition. Thus, the thermovolatile or thermosublimable coupler (a) is heat-transferred to the surface of the predetermined portions of the photosensitive material, and the light resolution of the diazonium salt (c) in the photosensitive material is caused to occur depending on the light transmission. When the so exposed photosensitive material is developed by a method known per se, at the predetermined portions to which the coupler (a) has been heat-transferred, the diazonium salt (c) at the non-exposed area is selectively reacted with the coupler (a) to form a dyestuff (c) - (a) and at other portion the diazonium salt (c) at the non-exposed portions is reacted with coupler (b) to form a dyestuff (c) - (b). Thus, a multicolored reproductive copy in which predetermined portions are colored in different hues is obtained.

The above-mentioned original sheet for multicolor development may be prepared, for instance, by a method comprising applying a coating composition containing the above-mentioned thermovolatile or thermosublimable coupler (a) onto the coupler-applied surface of a portion predetermined to have a different hue, of a transparent or semi-transparent original sheet, or by a method comprising coating or impregnating a transparent or semi-transparent substrate with the composition containing the above-mentioned thermovolatile or thermosublimable coupler (a) and combining the resulting sheet for heat-transfer of the coupler (a) with the coupler-applied surface of the specific portion of the original predetermined to have a different hue in a manner such that the layer containing the coupler (a) will confront the photosensitive material.

A coating composition for treating the coupler-applied surface of an original sheet to form a layer for heat-transfer of the coupler (a) can be easily prepared by dispersing a coupler (a) into a liquid, semi-solid or solid dispersion medium.

Such treating agent will now be described by referring to several embodiments.

(1) Ink-like composition for treating the coupler-applied surface of an original:

| | |
|---|---|
| Coupler (a) | 5.0 – 25.0% |
| Coloring material | 0 – 3.0 % |
| Binder | 0 – 5.0 % |
| Dispersion assistant | 0 – 2.0 % |
| Dispersion medium | balance |

As the dispersion medium, water and organic solvents such as alcohol, toluene. xylene, esters and methyl ethyl ketone may be used. It is possible to incorporate a coloring material so as to confirm the formation of a film of the treating agent, or to use a binder for the purpose of obtaining a good fixation of the coupler.

The composition of the above recipe is applied to the coupler-applied surface of a portion predetermined to have a different hue by means of a brush, an installed felt pen, a ball pen, coating roller, a sprayer or a printing machine.

(2) Waxy composition for treating the coupler-applied surface of an original:

| | |
|---|---|
| Coupler (a) | 5.0 – 25.0 % |
| Wax | 85.0 – 15.0 % |
| Oil | 10.0 – 40.0 % |
| Coloring material | 0 – 20.0 % |

The composition of the above recipe is shaped to have a crayon stick-like form or a chalk-like form, and the surface of a portion of an original predetermined to have a different hue is painted therewith. It is also possible to form a pressure-sensitive transfer sheet by melting the above composition or dissolving it in a suitable solvent and coating the melt or solution on a substrate such as paper and plastic film. The so formed pressure-sensitive transfer sheet is superposed on the coupler-applied surface of an original sheet, and then pressing is effected thereon by means of a typewriter or other writing means to form a heat-transferable layer on the coupler-applied surface of an original sheet predetermined to have a different hue.

(3) Coupler-transferring sheet for treating the coupler-applied surface of an original:

The ink-like composition for treating the coupler-applied surface of an original, which was described in (), or a composition obtained by incorporating a binder or an extender into such ink-like composition is coated on a transparent or semi-transparent sheet such as paper, plastic film or non-woven fabric. The so formed sheet for heat-transferring the coupler is cut into a desired size, if necessary, and then applied to the surface of a portion of an original determined to have a different hue. It is possible to form a pressure-sensitive adhesive layer on the back surface of the coupler-transferring layer to prevent it from exfoliating from the original.

The original sheet for multicolor development prepared with the use of the above-mentioned agent for treating the coupler-applied surface of an original sheet to be reproduced may be generally repeatedly used 5 to 100 times for multicolor development, though the applicable frequency of the repeated use varies depending on the amount of coupler (a) coated, the coating method, the heating method and the developing method. Of course, when the heat-transferability of coupler (a) in the layer for heat-transferring the coupler is lowered, it is only necessary to supply an additional layer for heat-transferring the coupler.

The above-mentioned original sheet for multicolor development is superposed on the photosensitive material in a manner such that the coupler-transferring layer applied on the original sheet will confront the photosensitive surface of the photosensitive material, and the exposure and heating are effected.

Various photosensitive materials containing a diazonium salt are used in this invention according to the developing method. They are usually formed by coating a sensitizing composition containing a diazonium compound and, if necessary, a coupler (b) on a substrate such as paper, plastic film, fibrous fabric, non-woven fabric and metal foil. Such photosensitive material will be now described by referring several examples.

A. Sensitizing composition for dry development:

| | |
|---|---|
| A. Sensitizing composition for dry development: | |
| Azo coupling component (b) | 0.2 – 5.0% |
| Diazo compound | 0.2 – 5.0% |
| Organic acid | 0.1 – 5.0% |
| Coloring matter | 0.001 – 0.025% |
| Development promoter | 1.0 – 10.0% |
| Extender | 0 – 2.5% |
| Solvent | balance |

The sensitizing composition of the above recipe is coated on a substrate such as paper and plastic film, and dried to form a photosensitive sheet.

B. Two-component-type sensitizing composition for wet development:

| | |
|---|---|
| Azo coupling component (b) | 0.2 – 5.0% |
| Diazo compound | 0.2 – 5.0% |
| Organic acid | 0.1 – 5.0% |
| Extender | 0 – 2.5 % |
| Stabilizer | 0 – 5.0% |
| Coloring matter | 0.001 – 0.025% |
| Solvent | balance |

The sensitizing composition of the above recipe is coated on a substrate such as paper and plastic film, and dried to form a photosensitive sheet.

C. One-component-type sensitizing composition for wet development:

| | |
|---|---|
| Diazo compound | 0.2 – 5.0% |
| Organic acid | 0.1 – 5.0% |
| Extender | 0 – 2.5 % |
| Coloring matter | 0.001 – 0.025% |
| Solvent | balance |

The sensitizing composition of the above recipe is coated on a substrate such as paper, and dried to form a photosensitive paper.

Any diazonium compound that is capable of being coupled with the above-mentioned couplers (a) and (b) under ordinary developing conditions may be used as the diazonium compound (c) in this invention. Examples of such diazonium compound are as follows:

Para-phenylene-diamine-N,N-substituted compounds of the following general formula:

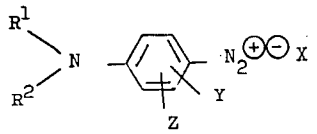

wherein X stands for an anion, $R^1$ and $R^2$ each are aliphatic hydrocarbon groups, and Z and Y denote substituents which can be introduced into the benzene nucleus.

Specific examples of the compounds of this type are as follows:

4-Diazo-N,N-dimethyl aniline
(referred to simply as "MA salt")
4-Diazo-N,N-diethyl aniline
(referred to simply as "EA salt")
4-Diazo-N-ethyl-N-β-hydroxyethyl aniline
(referred to simply as "EH salt")
4-Diazo-N,N-bis-β-hydroxyethyl aniline
4-Diazo-N-methyl-N-β-hydroxyethyl aniline
4-Diazo-N-ethyl-N-β-hydroxypropyl aniline
Other diazonium salts of p-phenylene diamines N,N-substituted with alkyl or hydroxy-alkyl groups
4-Diazo-N-ethyl-N-(β-diethylamino)-ethyl aniline
4-Diazo-2-chloro-N,N-diethyl aniline
4-Diazo-2-methyl-N,N-diethyl aniline
4-Diazo-2-iodo-N,N-diethyl aniline
4-Diazo-2-trifluoromethyl-N,N-diethyl aniline
4-Diazo-N-ethyl-N-benzyl aniline
4-Diazo-N-methyl-N-benzyl aniline
(referred to simply as "methyl benzyl")

Aminohydroquinone ether-type compounds of the following general formula:

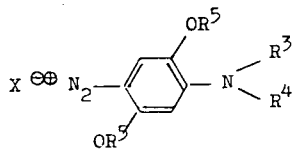

wherein $R^3$, $R^4$ and $R^5$ are alkyl or aryl groups and X stands for an anion.

Specific examples of the compounds of the above type are as follows:

4-Diazo-2,5-dibutoxy-N,N-diethyl aniline
4-Diazo-2,5-diethoxy-N-benzoyl aniline
(referred to simply as "BB salt")
4-Diazo-2,5-diethoxy-N-ethyl-N-benzoyl aniline
4-Diazo-2,5-dibenzyloxy-N-benzoyl aniline
4-Diazo-2-chloro-5-methoxy-N-benzoyl aniline
4-Diazo-2,5-diethoxy-N-benzoyl-methyl aniline
4-Diazo-2,5-diethoxy-N-benzoyloxy-methyl aniline Other 4-diazo-2,5-dioxyalkyl (or dioxyaryl)-N-alkyl (or aryl) compounds and derivatives thereof Aminodiphenyl compounds, aminodiphenyl amine compounds and their analogues of the following general formulas:

$X^{-+}N_2$-$R^6$A-$R^7$ and
$X^{-+}N_2$-$R^6$A-$R^7$-$N_2{}^{+-}X$ wherein X is an anion, $R^6$ is a divalent aryl group, $R^7$ is a monovalent or divalent aryl or alkyl group, A is a divalent group or a direct bond and examples of the $R^6$-A-$R^7$ are diarylamine (A; -NH-), diphenyl (A;direct bond), diphenyl oxide (A; -O-), diaryl methane (A; -$CH_2$-), stilbene (A; - CH=CH-) and diaryl or dialkyl sulfide (A; -S-).

Specific examples of the components of the above type are as follows:

Para-diazophenyl amine
4-Diazo-2,5,4'-triethoxydiphenyl amine
4-Diazo-2,5,4'-triethoxydiphenyl
4,4'-Bis-diazo-2,2',5,5'-tetrahydroxyphenyl methane
Bis-diazo-8,8'-dichloro-5,5'-dimethoxy benzidine
4-Diazo-2,5-dimethoxyphenylethyl sulfide
4-Diazo-2,5-diethoxy-4'-methyl-diphenyl sulfide Heterocyclic amine derivatives of the following general formula:

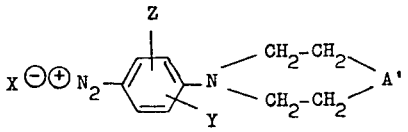

wherein X stands for an anion, Y and Z are substituents which can be introduced into the benzene nucleus, and A' is a direct bond or a divalent group such as -O-, -S- and methylene.

Specific examples of the compounds of this type are as follows:

4-Diazo-2,5-dibutoxy-N-phenyl morpholine
4-Diazo-2,5-diethoxy-N-phenyl morpholine
4-Diazo-2-methoxy-N-chio morpholine
4-Diazo-N-phenyl piperidine
4-Diazo-N-phenyl pyrrolidine
4-Diazo-2,5-di-n-butoxy-N-phenyl piperidine
Other derivatives of 4-Diazo-N-phenyl heterocyclic amines.

N,N-Substituted ortho-phenylene diamine derivatives and ortho-amino-phenol derivatives.

Specific examples of the compounds of this type are as follows:

2-Diazo-4-methylmercapto-N,N'-dimethyl aniline
2-Diazo-5-benzoylamino-N,N'-dimethyl aniline
2-Diazo-1-naphthol-5-sulfonic acid The above-mentioned diazonium compounds may be used in the form of a relatively stable salt with sulfuric acid or hydrochloric acid. They may also be used in the form of a double salt with zinc chloride, tin chloride, aluminum sulfate or the like. Further, they may be used in the state stabilized by an aryl sulfonate (in the form of a diazonium salt of an aromatic sulfonic acid), a diazosulfonate or the like.

The exposure of the photosensitive material and the transfer of the thermovolatile or thermosublimative coupler (a) to the photosensitive surface may be effected coincidentally. For instance, when a mercury lamp is used as the light source for exposure, the heat transfer of coupler (a) may be effected coincidentally with the exposure by the heat conveyed through a cylinder glass of the light source maintained at a relatively high temperature. Of course, the heat transfer of the coupler (a) may be also effected by the radiation heating of an image of the original. The heat transfer of coupler (a) may be effectively performed by heating the layer for heat-transferring the coupler at a temperature above 50°C., preferably above 70°C. and up to 180°C., though a preferable heating temperature varies to some extent depending on the kind of coupler (a) and the heating time. It is also possible to adopt a method comprising superposing the above-mentioned original for multicolor development and the photosensitive material, passing the assembly through a heated roller or an infrared radiation zone to heat the layer for heat-transferring the coupler at the above-mentioned temperature and to effect the heat transfer of the coupler, and then passing the same through an exposure zone to effect the exposure of the photosensitive material.

It is also possible to adopt a method in which the exposure and heat transfer are conducted in an order reverse to that of the above method, namely a method comprising superposing the original for multicolor development and the photosensitive material, passing the assembly through an exposure zone to effect the exposure of the photosensitive material and then passing the same through a heating zone to effect the heat transfer of coupler (a).

In accordance with this invention, the photosensitive material which has been exposed to light and on a predetermined portion of which the coupler (a) has been heat-transferred, is developed in the presence of a coupler (b) by means known per se. It is possible to incorporate coupler (b) in the photosensitive material in advance, or to incorporate coupler (b) in a developer. The development may be conducted by either a dry method or a wet method.

In accordance with the dry method, the development may be performed sufficiently only by exposing the light-exposed photosensitive material to a mixture of ammonia and steam. The development of a one-component-type photosensitive paper in use for the dry methiod may be carried out by coating a liquid developer having, for instance, the following recipe, on the photosensitive material by dipping, roller coating or spraying:

| | |
|---|---|
| Coupler (b) | 0.2 – 5% |
| Alkali | 0.5 – 10% |
| Reducing agent | 0 – 20% |
| Surface active agent | 0 – 0.5% |
| Water | balance |

In the case of a two-component-type photosensitive paper in use for the wet method, the development is achieved by contacting the photosensitive paper with an aqueous liquid developer containing an alkali.

Thus, in accordance with this invention multicolored reproductive copies in which the predetermine portion is colored by a dyestuff formed of coupler (a) and diazonium salt (c) and the other portion is colored by a dyestuff formed by coupler (b) and diazonium salt (c) can be provided.

This invention will be detailed by referring to the accompanying drawings.

Figure 5:
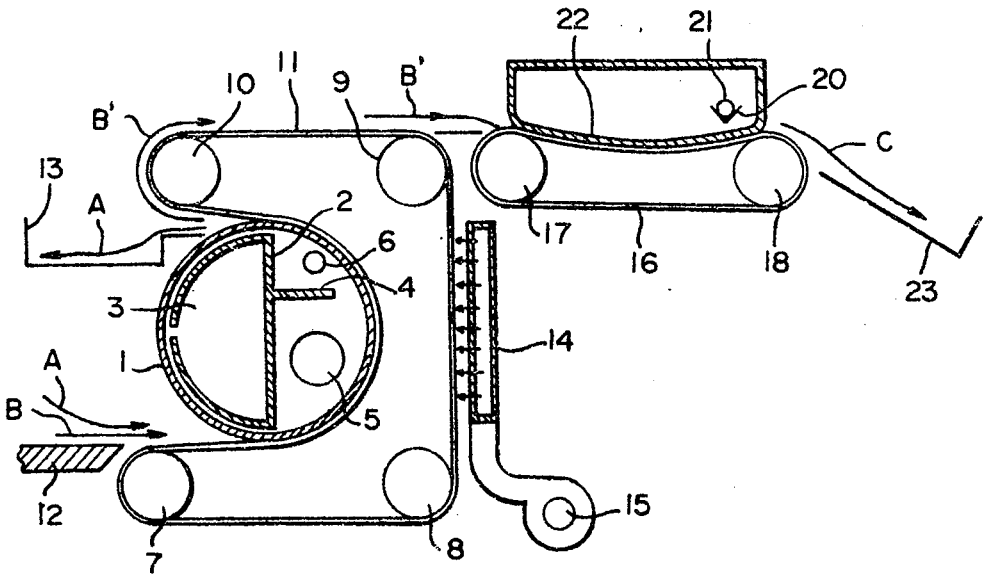
Figure 6:
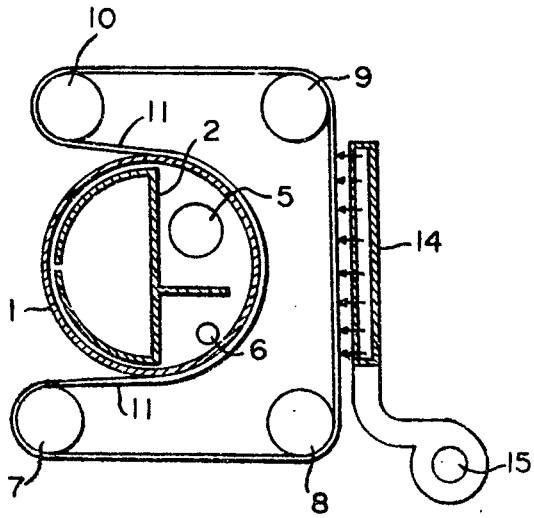
Figure 7:
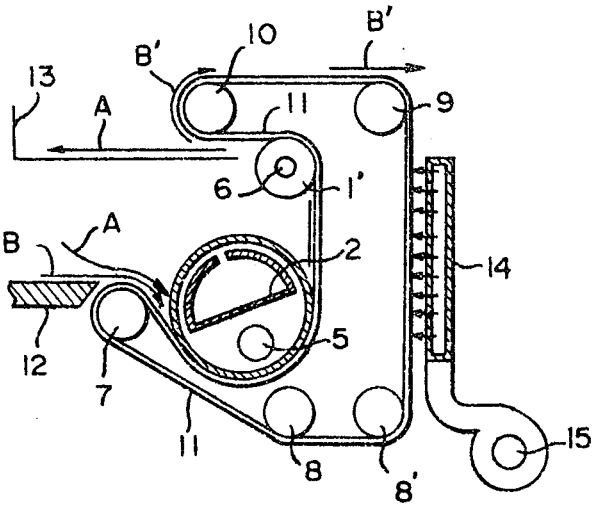
Figure 8:
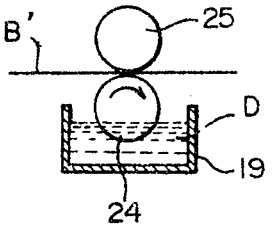
Figure 9:
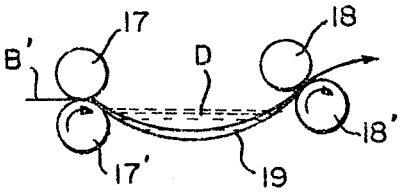
Figure 10:
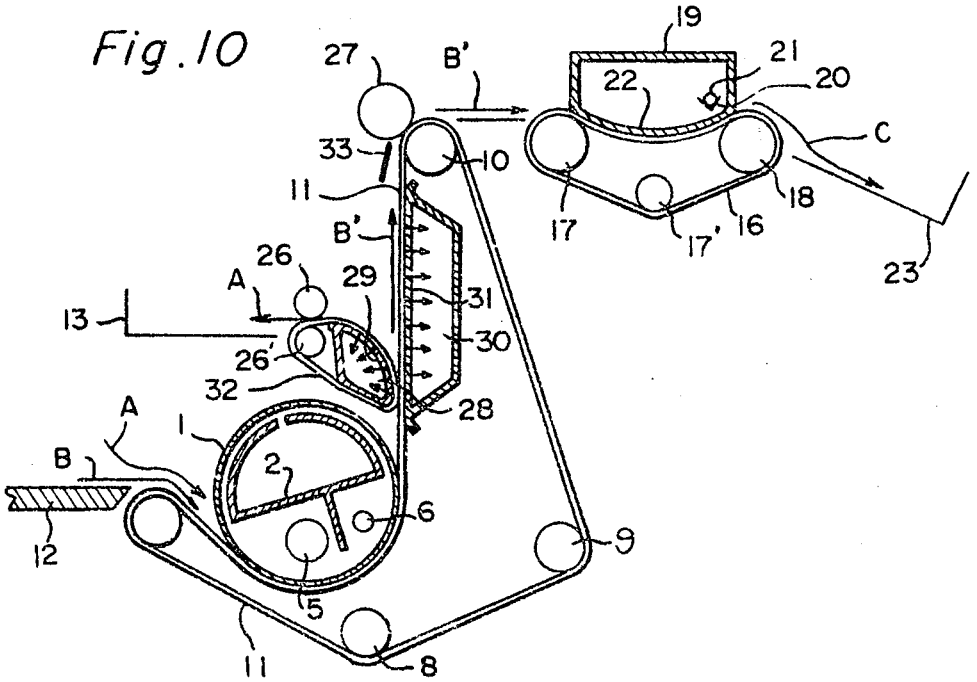
Figure 11:
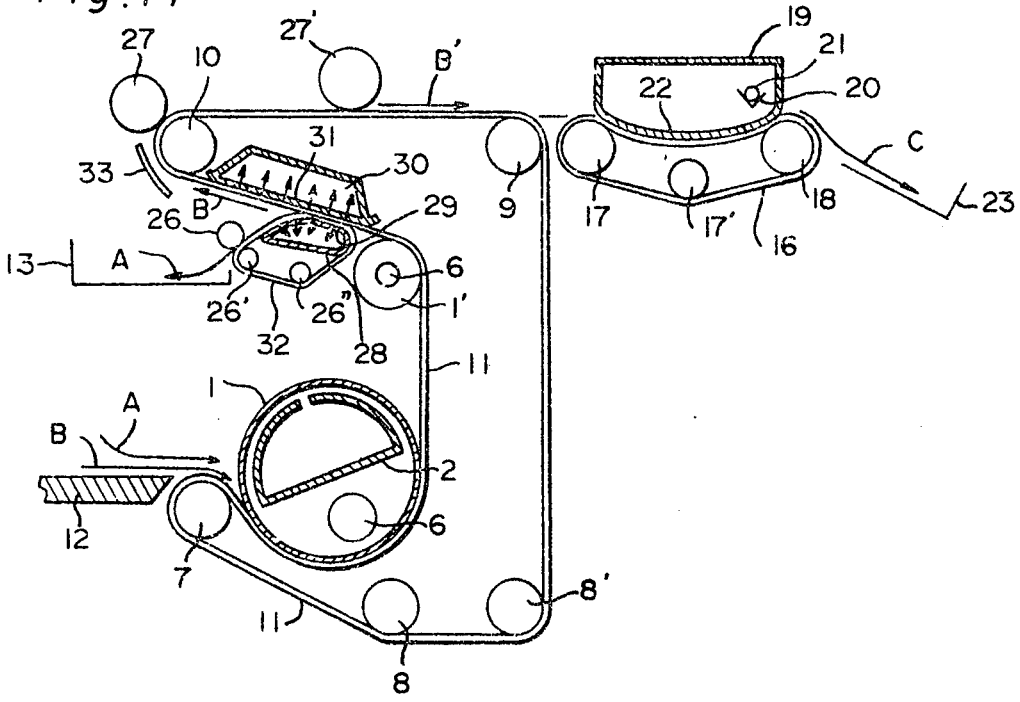
Figure 12:
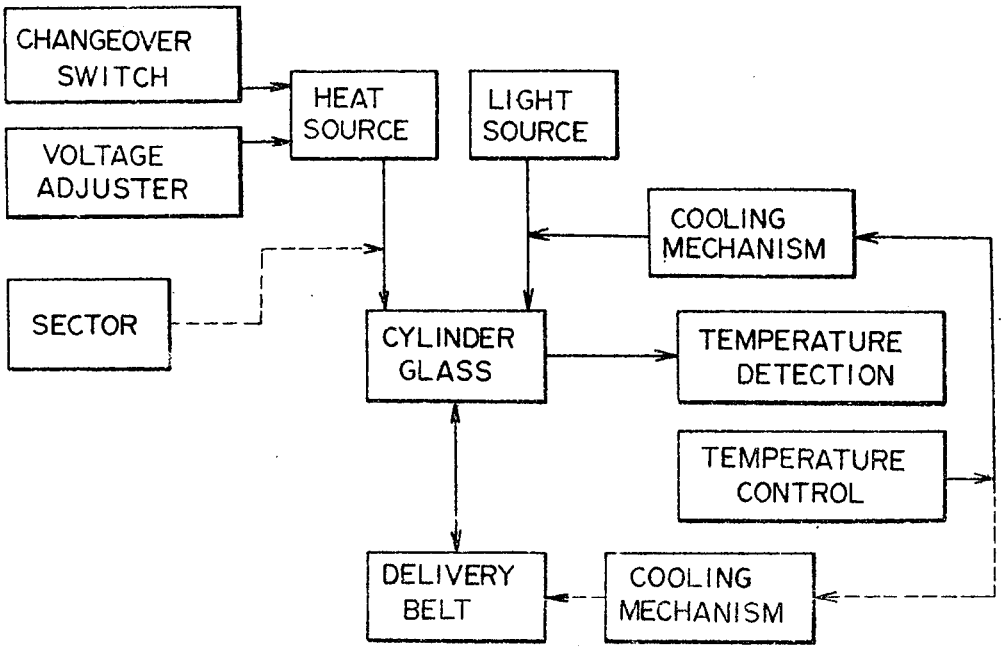

FIGS. 1 to 4 are given to explain the principles of light exposure, heat transfer and development in the process of this invention. FIG. 5 is a sectional diagram showing one embodiment of the apparatus of this invention. FIGS. 6 and 7 are views illustrating embodiments of the arrangement of a light source and a heat source. FIGS. 8 and 9 are views illustrating embodiments of the development mechanism. FIGS. 10 and 11 are views showing other embodiments of the apparatus of this invention. FIG. 12 is a block diagram illustrating a control system to be adaptable to the apparatus of this invention.

The principle of the process is first described. In FIG. 1, different thermovolatile or thermosublimative couplers 2' and 3' are coated on the surfaces of opaque images 2 and 3, respectively, of an original having images 1, 2 and 3. When the so formed original for multicolor development is superposed on a photosensitive paper, and exposed to light emitted from a suitable light source, latent images 1'', 2'' and 3'' corresponding to images 1, 2 and 3 are formed on the photosensitive layer of the base and couplers 2' and 3' are transferred on the upper surface of the photosensitive layer. When the above photosensitive sheet is developed, the diazonium salt in latent images 2'' and 3'' of the photosensitive layer is selectively reacted with transferred couplers 2' and 3', while the diazonium salt in latent image 1'' is reacted with a coupler contained in the photosensitive layer. Thus, a reproductive copy which has images 11, 12 and 13 colored in different hues is obtained.

Figure 2:
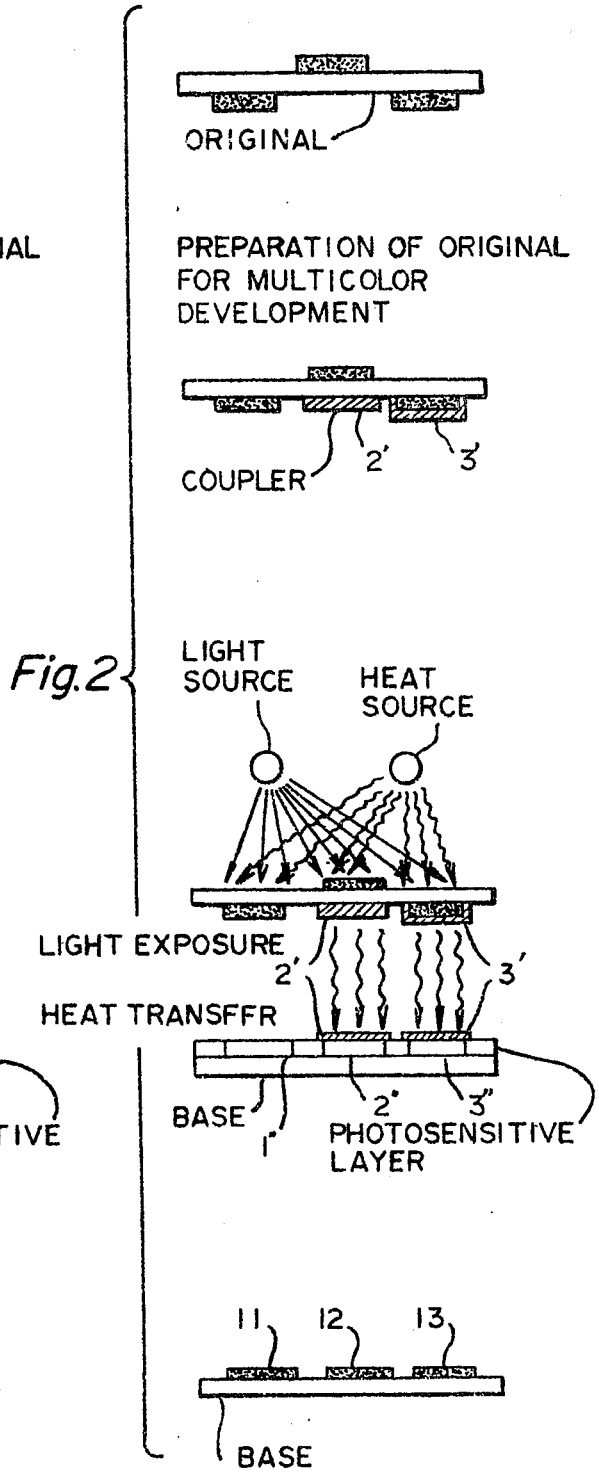

FIG. 2 illustrates another embodiment of the process of this invention where an original having an opaque image area 2 on one surface and opaque image areas 1 and 3 on the opposite surface is used as the original. Different thermovolatile or thermosublimable couplers 2' and 3' are coated on the opposite surface of the original at the portion continguous with the image 2 and on the surface of the image 3, and then, the light exposure, heat transfer and development are conducted by procedures as described by reference to the embodiment of FIG. 1, whereby a multi-color copy which has images 11, 12 and 13 colored in different dues can be obtained.

Figure 3:
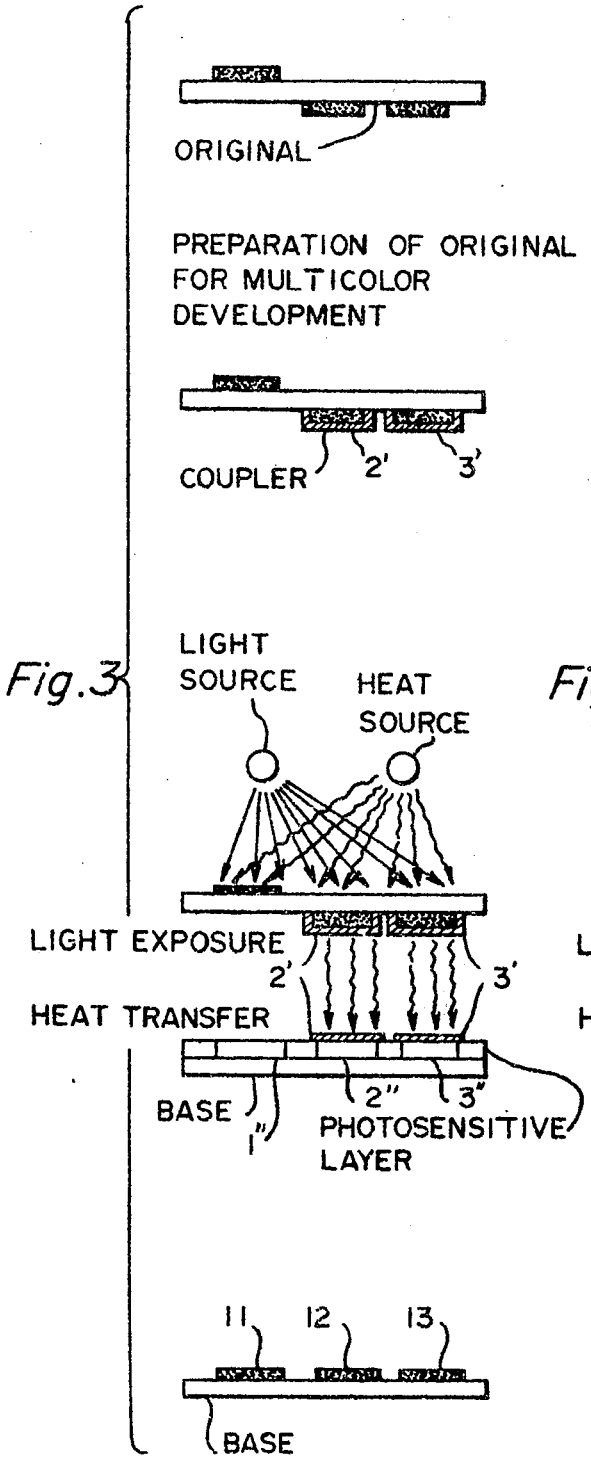

FIG. 3 illustrates still another embodiment of the process of this invention where an original having an opaque image on one surface and opaque images 2 and 3 on the opposite surface is used as the original. Different thermovolatile or thermosublimable coupler 2' and 3' are coated on the surfaces of images present on the opposite surface, and the light exposure, heat transfer and development are carried out by procedures as described by reference to the embodiment of FIG. 1, whereby a multi-color copy which has images 11, 12 and 13 colored in different hues can be obtained.

Figure 4:
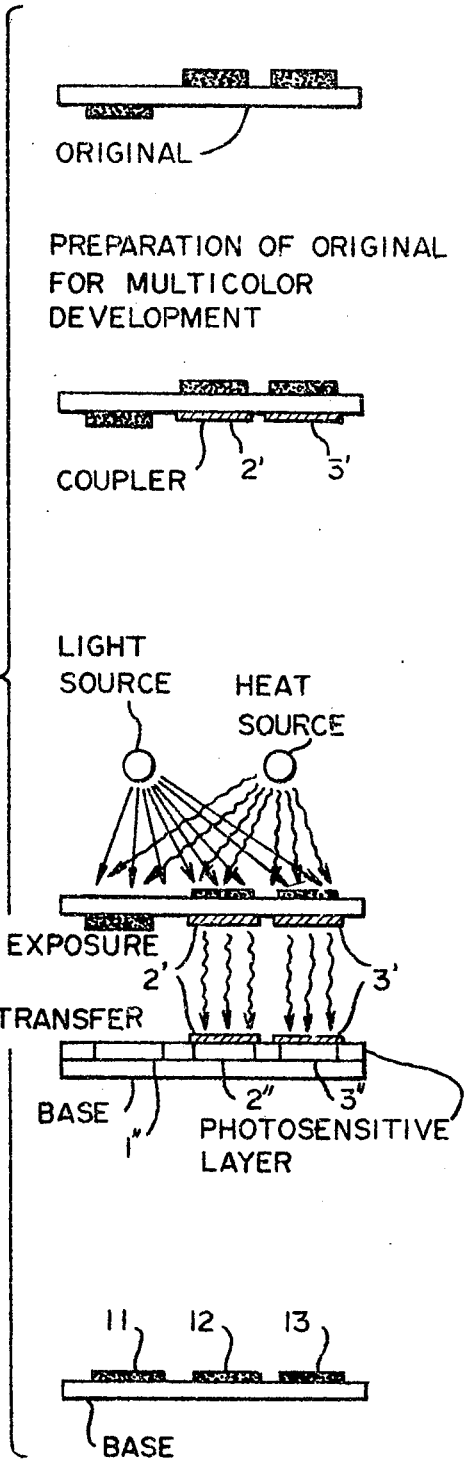

FIG. 4 illustrates a still further embodiment of the process of this invention where an original having an opaque image area 1 on one surface thereof and opaque images 2 and 3 on the opposite surface is used as the original. Different thermovolatile or thermosublimable couplers are coated on areas contiguous with the images 2 and 3, and the light exposure, heat transfer and development are conducted by procedures as described by reference to the embodiment of FIG. 1, whereby a multicolor copy having images 11, 12 and 13 colored in different hues can be obtained.

The process of this invention can be performed by the following apparatus, namely, an apparatus for the diazo-type multicolor reproduction which comprises a light source for exposing a diazo-type photosensitive material to light; a heat source for transferring a thermovolatile or thermosublimative coupler from a layer of the coupler to a photosensitive layer of the photosensitive material on which the coupler layer is overlapped; a developing mechanism for developing the ligh-exposed photosensitive material on which the coupler has been heat-transferred; and a delivery mechanism for feeding the diazo-type photosensitive material, the thermovolatile or thermosublimative coupler layer and the original to a device for subjecting them to actions of the light source and heat source while maintaining them in the overlapped stage and contacting them with such device, and feeding only the light-exposed and heat-transferred photosensitive material to the development mechanism.

Any light source that can emit a light of a wavelength sufficient to resolve the diazonium salt in the photosensitive material may be used as a light source of the apparatus of this invention. A fluorescent lamp, a low voltage or high voltage mercury lamp, a xenon lamp, an arc lamp or an incandescent lamp may be optionally used. It is preferably that such light sources are contained in a rotatable transparent cylinder, so that the diazo-type photosensitive material is exposed to light in close contact with the original. When a light source is provided in a transparent cylinder, a suitable cooling mechanism may be provided to cool the light source and transparent cylinder to suitable temperatures.

Any heat source that can heat-transfer a thermovolatile or thermosublimative coupler to a photosensitive layer from a layer of the coupler formed at the surface of the original and overlapped on the photosensitive layer may be used as a heat source of the apparatus of this invention. An electric heater, heating roller, an infrared lamp, a heated jet or a high frequency heater may be optionally used. In order to conduct the heat transfer of the thermovolatile or thermosublimative coupler to the photosensitive layer effectively, it is preferable to prevent the escape of the coupler transferred to the diazotype photosensitive layer by maintaining the thermovolatile or thermosublimative coupler layer at a temperature higher than that of the photosensitive layer and thus forming a temperature gradient between the two layers. To achieve the above result it is especially preferable to use an infrared lamp. Radiations emitted from an infrared lamp selectively heat images of the original, whereby the thermovolatile or thermosublimative coupler can be effectively heat-transferred to the diazo-type photosensitive layer from portions of the coupler layer corresponding to images. The wavelength of an infrared lamp is not critical, but based on experiments it was confirmed that in order to obtain as many multicolored reproductive copies as possible from one original treated with the thermovolatile or thermosublimative coupler it is most preferred to use an infrared lamp that can radiate substantially near infrared rays. Also these heat sources may be contained in a rotatable cylinder in which they are contacted with a piled assembly of the original, the coupler layer and the photosensitive layer.

A superposed assembly of the original, the coupler layer and the photosensitive layer may be subjected to actions of the light source and heat source coincidentally. Alternately, it may be exposed at first to light by means of the light source and then heated by means of the heat source to effect the heat transfer. It is also possible to effect the heat transfer by means of the heat source first, followed by the light exposure by the light source.

The light source and heat source may be contained in a unit transparent cylinder. In this case, a cold air duct of a semi-cylindrical form is fixed to a frame of the apparatus and a partition plate is provided on the reflecting surface of the cold air duct. In two chambers defined by the partition plate, heat and light sources are separately provided approximating the cylinder surface. It is also possible to provide heat and light sources in two separate rotatable transparent cylinders or to provide only the light source in a transparent cylinder and to effect the heat transfer at a different place by means of a heating roller or a heated jet.

The diazo-type photosensitive material which has been exposed to light and on which the coupler has been heat-transferred, is separated from the original and coupler layer, and it is fed alone to the development mechanism where it is developed. The development mechanism may be of either the dry or wet type. In the case of the dry development, a developer mechanism of such a structure is used that a heated mixture of ammonia and steam is uniformly contacted with the photosensitive material. In the case of the wet development, a development mechanism in which a liquid developer for the wet development is coated on the photosensitive material by means such as roller coating, dipping coating and spraying is generally used.

The delivery mechanism comprises a device for subjecting the photosensitive material, the coupler layer and the original to actions of the light source and heat source, for instance, an endless belt driven in contact with a rotatable transparent cylinder, and a moving endless belt or at least one pair of rollers provided in contact with, or in proximity of, the development mechanism. The original, the thermovolatile or thermosublimative coupler layer and the diazo-type photosensitive layer overlapped in this order are allowed to pass through a passage formed between the endless belt and the light-exposure and heat-transfer zone where they are subjected to actions of the heat and light sources, whereby the photosensitive layer is exposed and the coupler is heat-transferred on the photosensitive layer, after which the photosensitive layer is forwarded from the light-exposure and heat-transfer zone, separated from the original and coupler layer manually or by suitable means, and then delivered to the development mechanism by means of an endless belt or rollers.

In this invention it is preferable to reduce the heat given to the endless belt to a minimum degree possible. Therefore, it is desired to provide a suitable cooling member or to select a material or color of the endless belt which is not easily heat-receivable.

In the embodiment illustrated in FIG. 5, in a rotatable, transparent cylinder 1 a cold air duct 3 one of whose walls constitutes a reflective plate 2 is provided. On the opposite side of the reflective plate 2 of the cold air duct two chambers are provided and they are defined by a reflective partition 4. In these chambers a light source 5 consisting of a high voltage mercury lamp and a heat source 6 consisting of an infrared lamp radiating substantially near infrared rays are mounted, respectively. Each of the light source 5 and heat source 6 is fixed to the reflective plate via a suitable supporting member. On the circumferential wall of the cold air duct 3 a hole-like or slit-like slot or the like is formed through which the cold air fed from one or both ends of the duct is projected to the inside of the cylinder. Thus, the cold air cools the light source 5 and the cylinder wall, and then is discharged from the side opposite to the duct. An endless belt 11 is mounted in the figured form through rollers 7, 8, 9 and 10. The endless belt 11 is driven by means of, for instance, roller 7 and/or roller 10. By the movement of the endless belt 11, the cylinder 1 rotatably suported on the apparatus frame is also rotated. On the feed side of the endless belt 11 a paper-feeding table 12 may be provided, and an original receiving saucer may be provided on the discharge side of the endless belt 11.

It is desired to prevent the endless belt 11 as much as possible from being heated. For this purpose, it is possible to select as the material or color of the endless belt one that is not easily heat-receivable and/or to cool the endless belt 11 by providing between rollers 8 and 9 a cooling duct 14 with an opening for projecting the cold air fed from a fan 15. Of course, it is also possible to maintain the temperature of the endless belt at low levels by cooling the roller 8 with a suitable cooling medium instead of providing such cooling duct.

Another endless belt 16 is provided between rollers 17 and 18 in the position adjacent to the endless belt 11 and contacting a developer 19. The endless belt 16 is driven by means of a roller 18 at the rate synchronized with the endless belt 11. In the developer 19 a plate 20 for evaporating aqueous ammonia and an evaporation heater 21 are provided. The gasified ammonia and steam are introduced onto the photosensitive layer through a plurality of openings formed on a wall 22 of the endless belt 16.

When the reproduction is conducted by using the above-mentioned apparatus of this invention, as is shown in FIGS. 1 to 4, an original (A) on which a layer of a thermovolatile or thermosublimative coupler if formed is superposed on a diazo-type photosensitive material (B), and an assembly of (A) and (B) is fed to a passage between the cylinder 1 and the endless belt 11, exposed to light by means of the light source 5 and heated by means of the heat source 6. The original (A) and the photosensitive material (B′) on which the coupler has been transferred are discharged from between the cylinder 1 and the endless belt 11 and the original (A) is received on the saucer 13, while the photosensitive material (B′) is manually separated from the original (A), placed on the endless belt 11 and introduced into a passage formed between the endless belt 16 and the wall 22 of the developer where it is allowed to come into contact with gasified ammonia and steam and thus be developed. The developed copy (C) is received on the saucer 23.

It is also possible to effect the heat transfer of the coupler first and then the light exposure by providing, as is shown in FIG. 6, a heat source 6 consisting of an infrared lamp in the lower portion of the cylinder 1 and a light source 5 consisting of a high voltage mercury lamp in the upper portion of the cylinder 1.

FIG. 7 illustrates an embodiment in which light source 5 and heat source 6 are provided separately. In the cylinder 1 a light source 5 consisting of an ultraviolet lamp is mounted on a reflective plate 2, and in another cylinder 1′ a heat source 6 consisting of an infrared lamp is provided.

The endless belt 11 is driven by means of, for instance, rollers 7 and 10 and is rotated while being in contact with the cylinder 1 to rotate the same. Then, the endless belt 11 falls in contact with the cylinder 1′ to rotate the same, and passes through rollers 10 and 9, a cooling zone, and rollers 8 and 8′ in this sequence. Instead of the infrared lamp 6 and cylinder 1′ a hot wheel 1′ provided with an electric heater 6 may be used as the heat source. The function and operation of each member are the same as in the embodiment shown in FIG. 1.

FIG. 8 illustrates an embodiment of the wet development mechanism using a liquid developer. A photosensitive material (B′) which has been exposed to light and on which the coupler has been transferred in dipped in a liquid developer (D) contained in a liquid developer tank 19, and is allowed to pass through rotating roller 24 and developing roller 25 by which the liquid developer is coated on the photosensitive material (B′) and the development thereof is effected. The developing roller is formed of a material capable of maintaining thereon the liquid developer conveyed by the roller 24 and applying it to the photosensitive surface of the photosensitive material (B′), such as a multicellular material. In an embodiment shown in FIG. 9, the photosensitive material (B′) which has been exposed to light and on which the coupler has been heat-transferred is dipped in the liquid developer contained in a developing saucer 19 by means of a pair of paper-feeding rollers 17 and 17′, and is developed. Then, the developed photosensitive material (B′) is allowed to pass through a pair of squeezing rollers 18 and 18′ and discharged in the form of a copy. In embodiments shown in FIGS. 8 and 7, roller 24, developing roller 25, paper-feeding rollers 17 and 17′, and squeezing rollers 18 and 18′ should be driven at a superficial speed synchronized with the endless belt running through the light-exposure and heat-transfer zones.

In an embodiment of the apparatus of this invention shown in FIG. 10, a roller 10 for supporting and rotating the endless belt 11 is provided in the direction almost vertical to the cylinder 1. Between the cylinder 1 and the roller 10 a suction chamber 30 is disposed contacting the back surface of the endless belt 11. A plurality of openings are formed on the wall 31 of the suction chamber 30 contacting the belt 11. On the opposite side of the endless belt 11 another suction chamber 28 is disposed to confront the suction chamber 30. In this suction chamber 28 a cured wall 29 having a plurality of openings is formed. At the other end of the suction chamber 28, rollers 26 and 26′ are provided. An endless belt 32 is hung on the roller 26′ and the suction chamber 28, and the belt 32 is driven by the driving roller 26′ at a rate synchronized with the endless belt 11. The original (A) and the photosensitive material which has been exposed to light and on which the coupler has been heat-transferrd is introduced into a passage formed between the driving belt 11 and the belt 32, and the original (A) is sucked to the belt 32 through perforations or openings of the belt 32 and received on a saucer 13 via rollers 26 and 26′, while the photosensitive material (B′) is sucked toward the suction chamber 30 through perforations or openings of the belt 11, allowed to move upwardly in the state adhering to the belt 11, and to pass through a passage between a guiding plate 33 and the belt 11, and delivered to the development mechanism while being gripped by a roller 27.

In the apparatus of the above type, the separation of the original from the photosensitive material which has been exposed to light and on which the coupler has been heat-transferred can be achieved automatically, and the photosensitive material can be automatically fed to the development mechanism. Further, the belt 11 is cooled by the suction mechanism provided adjacently thereto. Accordingly, the apparatus of this type is very advantageous.

FIG. 11 illustrates an embodiment similar to that shown in FIG. 10, except that light source 5 and heat source 6 are provided in cylinders 1 and 1′, respectively.

Also in the apparatus shown in FIGS. 10 and 11, it is possible to adopt other development mechanisms described with respect to the apparatus shown in FIGS. 8 and 9.

In the apparatus of this invention, it is preferably to provide a mechanism for controlling the temperatures of a cylinder glass and a delivery belt. A suitable temperature control mechanism adoptable in this invention is illustrated in the block diagram of FIG. 12. A temperature-detecting member such as a thermocouple or a thermistor is provided adjacent to the glass cylinder containing light and heat sources or in contact therewith. A cold air duct such as described hereinabove is provided in the cylinder glass and the cooling of the cylinder glass may be effected and adjusted by the changeover of a motor switch of a cold air-feeding fan or by means of a throttle valve mounted on a duct of the fan. It is also possible to provide the delivery belt with a cooling mechanism such as described above. Since the delivery belt falls in contact with the cylinder glass, the temperature of the delivery belt is the same as, or a little lower than, the temperature of the cylinder glass. A certain range of the temperature is prescribed with respect to the cylinder glass depending on the kinds of the original and thermovolatile or thermosublimable coupler (for instance, optionally selected from temperatures ranging from 60° to 150°C.), and when the temperature of the cylinder deviates from such prescribed range, the cooling mechanism for the cylinder glass, optionally together with the cooling mechanism of the delivery belt, is adjusted so as to control a further increase of the temperature. Thus, the temperatures of the cylinder and delivery belt can be maintained at a certain prescribed level. Further, since the heat-transferable coupler layer which is positioned between the cylinder glass and delivery belt is more greatly heated by means of a heat source such as an infrared lamp, among the coupler layer, the photosensitive layer and the delivery belt, a temperature gradient suitable for the effective heat transfer of the coupler can be obtained. In order to keep the temperature of the coupler layer at an optimum condition for the heat transfer, it is possible to provide a device for adjusting the electric voltage of the heat source or a sector for adjusting amounts of infrared rays to be radiated. In order to make the apparatus of this invention applicable also to an ordinary diazo-type monochromatic reproduction process, it is desired to provide separately a changeover switch for the heat source.

The process of this invention is utilized effectively in various applications in the field of diazo-type reproduction, and it is especially useful and valuable in the following cases.

In diazo-type reproduction, it is most common to conduct the light exposure in such a manner that the original and the photosensitive material are superposed so that the opaque image-free surface of the original has a face-to-face contact with the photosensitive layer of the photosensitive material, and then conduct the development. However, when especially clear copies are required, first the original and the photosensitive material are superposed so that the opaque image-carrying surface of the original is in face-to-face contact with the photosensitive layer of the photosensitive material, followed by light exposure and development, to thereby prepare an intermediate copying original having opaque reverse images (which process is frequently called "reverse printing"). Then, a plurality of diazo copies are formed by employing as the original this intermediate copying original. In this case, the intermediate copying original and the photosensitive material are superposed so that the opaque reverse image-carrying surface of the intermediate copying original has a face-to-face contact with the photosensitive layer of the photosensitive material and in this state the light exposure is effected, followed by development. Thus, copies having clear positive images can be obtained. This copying process is especially advantageous in obtaining copies of plans and the like.

The process of this invention can be effectively applied to the reproduction of such intermediate copying originals, though this invention is not limited to such embodiment alone. More specifically, when a layer containing a thermovolatile or thermosublimable azo coupler (a) is located on the surface of the preselected reverse image area of the intermediate copying original, it is possible to obtain a great number of copies having a multi-colored positive image.

Further, in construction plans, shipbuilding plans and the like, intermediate copying originals are frequently prepared by re-touching the original plan on the back surface with additional patterns or the like. The process of this application can be conveniently and effectively applied to the reproduction of such intermediate copying originals having opaque images on both surfaces thereof.

In accordance with this invention it is possible to obtain copies in which predetermined portions are clearly colored in different hues, and further, the multicolor development can be effected only by one developing step. Still further, when the original is once treated, at least 5 sheets, generally 20 to 100 sheets, of multicolored reproductive copies can be obtained from the original. Accordingly, it is unnecessary to repeat the treatment of the original for every copy. In addition, in this invention the treated original for multicolor development can be easily restored into the former untreated condition by peeling off the sheet of the heat-transferable coupler or by subjecting the coupler-coated original to a mere heat treatment at about 100°C.

The reproduction process of this invention is particularly advantageous for reproducing important or significant portions of originals such as papers, drawings and charts into hues different from those of other portions and is effective for obtaining ordinary multicolor copies or colored copies.

This invention will be described hereinbelow by referring to examples.

Examples of the preparation of ink-like agents for treating the coupler-applied surface of an original

EXAMPLE A

An ink-like composition of the following recipe is prepared as a yellow color-forming agent for treating the coupler-applied surface of an original:

| | |
|---|---|
| Acetoacetic anilide | 20 g |
| Alkyd resin | 5 g |
| Toluol | 100 ml |

The above composition is directly used as a material to be coated on the surface of a portion of the original desired to be reproduced in yellow by means of a brush, a coating roller or a sprayer, or after it has been charged in a felt pen or a ball pen, it is used as a material for treating the coupler-applied surface of a portion of the original desired to be reproduced in yellow.

EXAMPLE B

An ink-like composition for treating the coupler-applied surface of an original, which resembles that of Example A, is prepared by using acetoacetic-o-chloroanilide instead of acetoacetic anilide in Example A.

EXAMPLE C

An ink-like composition of the following recipe is prepared as a red color-forming agent for treating the coupler-applied surface of an original:

| | |
|---|---|
| Resorcin | 20 g |
| Vinyl acetate resin | 5 g |
| Methanol | 100 ml |

The above composition is directly used as a material to be coated on the back surface of a portion of the original to be reproduced in red to brown by means of a brush, a coating roller or a sprayer, or after it has been charged in a felt pen or a ball pen, it is used as a material for treating the coupler-applied surface of a portion of the original to be reproduced in red to brown.

EXAMPLE D

A treating agent for forming a red-to-orange color is prepared by using o-amino-phenol instend of resorcin in Example C.

EXAMPLE E

An ink-like composition of the following recipe is prepared as a blue color-forming agent for treating the coupler-applied surface of an original:

| | |
|---|---|
| 2,3-Dihydroxynaphthalene | 15 g |
| Modified styrene resin | 5 g |
| Ethanol | 100 ml |

The above composition is directly used as a material to be coated on the coupler-applied surface of a portion of the original desired to be reproduced in blue by means of a brush, a coating roller or a sprayer, or after it has been charged in a felt pen or a ball pen, it is used as a material for treating the coupler-applied surface of a portion of the original desired to be reproduced in blue.

EXAMPLE F

A treating agent similar to that of Example E is prepared by using 2,7-naphthylene diamine instead of 2,3-dihydroxynaphthalene in Example E.

Examples of the preparation of waxy agents for treating the coupler-applied surface of an original

EXAMPLE G

A waxy composition to be used as a yellow color-forming agent for treating the coupler-applied surface of an original is prepared by heat melting and solidifying the melt.

| | |
|---|---|
| Acetoacetic anilide | 30 g |
| Stearic acid | 100 g |
| Paraffin | 50 g |
| Terra alba | 50 g |
| Diatomaceous earth | 20 g |

The above composition is molded into a crayon stick-like form and is used as a material to be coated on the surface of a portion of the original desired to be reproduced into a different hue.

EXAMPLE H

To the composition of Example G 100 g of mineral oil, 50 g oleic acid and 20 g of Auramine, and the mixture is kneaded in a ball mill to disperse additional components uniformly. Then, the kneaded mixture is coated on a substrate such as paper to obtain a pressure-sensitive copy sheet. The so formed copy sheet is superposed on the coupler-applied surface of an original and the pressing is effected thereon by means of a typewriter or other writing means. Thus, the sheet is used as a material for forming a layer of the waxy agent on the coupler-applied surface of an image of the original to be reproduced in a different hue.

EXAMPLE I

A waxy composition to be used as a red color-forming agent for treating the coupler-applied surface of an original is prepared by heat melting and solidifying the melt.

| | |
|---|---|
| Resorcin monoglycol ether | 20 g |
| Paraffin | 50 g |
| Terra alba | 70 g |
| Haze wax | 20 g |
| Stearic acid | 100 g |
| Magnesium carbonate | 20 g |

The so formed composition is molded into a crayon stick-like or chalk-like form and is used as a material for coating the coupler-applied surface of a portion of an original desired to be reproduced in a different hue.

EXAMPLE J

To the composition of Example I 100 g of mineral oil, 30 g of oleic acid and 20 g of Permanent Red are added, and the resulting mixture is kneaded in a ball mill, coated on a substrate such as paper and dried to obtain a pressure-sensitive copy sheet. This copy sheet is used as a material for forming a layer of the waxy agent on the coupler-applied surface of an original in a manner as described in Example H.

EXAMPLE K

A waxy composition of the following recipe is prepared as a blue color-forming agent for treating the coupler-applied surface of an original:

| | |
|---|---|
| 2,3-Dihydroxynaphthalene | 50 g |
| Stearic acid | 100 g |
| Paraffin | 50 g |
| Diatomaceous earth | 30 g |
| Haze wax | 20 g |

The above composition is molded into a crayon stick-like or chalk-like form and is used as a material for coating the coupler-applied surface of a portion of the original desired to be reproduced in a different hue.

EXAMPLE L

To the composition of Example K 100 g of mineral oil, 30 g of oleic acid, 20 g of Oil Blue and 50 ml of ethanol are added, and the mixture is kneaded in a ball mill, coated on a substrate such as paper and dried to obtain a pressure-sensitive copy sheet. This sheet is used as a material for forming a layer of the waxy agent on the coupler-applied surface of an original in a manner as described in Example H.

Examples of the preparation of coupler-transferring sheets for treating the coupler-applied surface of an original

EXAMPLE M

A composition of the following recipe is prepared as a yellow color-forming agent treating the coupler-applied surface of an original:

| | |
|---|---|
| Acetoacetic acid aniline | 20 g |
| Triacetate resin | 10 g |
| Methanol | 30 ml |
| Acetone | 30 ml |

The above composition is coated on a transparent or semi-transparent sheet such as polyester film by means of a rod coater and dried at a relatively low temperature (40° – 50°C.) to form a sheet for heat-transferring the coupler. After being cut into a desired size according to need, the sheet is used as a material to be applied to the coupler-applied surface of a portion of an original desired to be reproduced in a different hue.

EXAMPLE N

A composition to be used as a red color-forming agent for treating the coupler-applied surface of an original is prepared by using resorcin instead of acetoacetic acid aniline in Example M. From this composition a sheet for heat-transferring the coupler capable of forming a red color is formed.

EXAMPLE O

A composition to be used as a blue color-forming agent for treating the coupler-applied surface of an original is prepared by using 1,6-dihydroxynaphthalene instead of acetoacetic acid aniline in Example M. From this composition a heat-transferable sheet capable of forming a blue color is formed.

EXAMPLE P

A waxy composition of the following recipe is used as a black color-forming agent for treating the coupler-applied surface of an original:

| | |
|---|---|
| Mineral oil | 100 g |
| Diatomaceous earth | 50 g |
| Stearic acid | 30 g |
| Resorcin | 10 g |
| Acetoacetic anilide | 20 g |
| Carbon black | 30 g |
| Alkali Frex Blue | 5 g |

The above composition is well kneaded in a ball mill, coated on a substrate such as paper and dried to form a pressure-sensitive copy sheet. The sheet is used as material for forming a layer of the waxy composition on the coupler-applied surface of the original in a manner as described in Example H.

EXAMPLE 1

Multicolor-forming diazo-type photosensitive paper for use in wet development

10 G of a double salt of 4-diazo-2,5-diethoxycenzoylaniline chloride .1/2 $ZnCl_2$, 8 g of citric acid, 0.1g of Patent Blue and 10 g of dextrin are successively dissolved in water, to make 1 liter of a solution. The solution is coated on a base paper and dried to obtain a diazo-type photosensitive sheet for wet development.

A semi-transparent first original having an image and a photosensitive sheet for a diazo-type intermediate copying original prepared by a customary method are superposed, and the assembly was exposed to light emitted from above to form an intermediate copying original. A part of the image of this intermediate copying original is treated with the ink composition prepared in Example A and another part of the image is treated with the treating material prepared in Example C to obtain an original for multi-color reproduction.

The so formed original for multi-color reproduction is superposed on the above photosensitive sheet so that the treated surface of the original is in close face-to-face contact with the photosensitive layer of the photosensitive material, and the assembly is heated by a mercury lamp to form a latent image of the diazonium salt and simultaneously heat-transfer the heat-transferable couplers to the areas of the photosensitive sheet corresponding to the treated parts of the original. Then, the so exposed and heat-transferred photosensitive sheet is developed with use of a liquid developer of the following recipe:

| | |
|---|---|
| NW acid | 20 g |
| Potassium carbonate | 20 g |
| Sodium thiosulfate | 40 g |
| Sodium bicarbonate | 30 g |
| Activating agent | 1 g |
| Water | balance |
| Total | 1 liter |

Thus, a clear multicolor reproductive copy in which a portion corresponding to the portion treated with the treating material prepared in Example A is colored in yellow, a portion corresponding to the portion treated with the treating material of Example C is colored in red and other portion corresponding to the non-treated portion is colored in bluish violet is obtained.

EXAMPLE 2

Instead of the original-treating materials used in Example 1, the sheets for heat-transferring the coupler prepared in Examples M and N are applied to the coupler-applied surfaces of two different portions of an original, respectively. When printing and development are effected in the same manner as in Example 1, a multicolor reproductive copy similar to that obtained in Example 1 is obtained.

EXAMPLE 3

Multicolor-forming diazo-type photosensitive paper for use in dry development

A solution of the following recipe is prepared:

| | |
|---|---|
| 4-Diazo-N-ethyl-N-β-hydroxyethylaniline chloride·½ $ZnCl_2$ | 10 g |
| Ethylene glycol | 50 g |
| Citric acid | 20 g |
| Bis-[5-hydroxy-7-sulfonaphthyl(2)] amine | 15 g |
| Zinc chloride | 40 g |
| Thiourea | 30 g |
| Patent Blue | 0.1 g |
| Water | balance |
| Total | 1 liter |

The solution is coated on a base paper by a customary coating procedure such as using an air knife coater and dried to form a photosensitive sheet.

An intermediate copying original having opaque reverse images is prepared according to the customary diazo-type reproduction method. The surface of a preselected reverse image of the intermediate copying sheet is treated with the treating material prepared in Example B, the surface of another preselected reverse image is treated with the treating material prepared in Example C, and the surface of still another preselected reverse image is treated with the treating material prepared in Example E. The so treated intermediate copying original is superposed on the above photosensitive sheet so that the treated surface of the original is in face-to-face contact with the photosensitive layer of the photosensitive sheet. Then the assembly is heated and exposed to light by means of a mercury lamp to form a latent image of the diazonium salt.

Next, the so treated sheet is subjected to development with gasified ammonia and steam. Thus, a clear multicolor copy in which a portion corresponding to the portion treated with the material of Example B is colored in an orange color, a portion corresponding to the portion treated with the material of Example C is colored in reddish brown, a portion corresponding to the portion treated with the material of Example E is colored in bluish violet, and another portion corresponding to the untreated portion is colored in dark blue is obtained.

EXAMPLE 4

When Example 3 is repeated by using N,N-bis-[1-hydroxy-3-sulfonaphthyl(6)] thiourea instead of bis-[5-hydroxy-7-sulfonaphthyl(2)] amine, a multicolor reproductive copy similar to that of Example 3 is obtained.

EXAMPLE 5

Multicolor-forming photosensitive paper for use in dry development

A solution of the following recipe is prepared:

| | |
|---|---|
| 4-Diazo-N,N-dimethylaniline chloride·½ $ZnCl_2$ | 10 g |
| Diethylene glycol | 40 g |
| Citric acid | 30 g |
| 2,3-Dihydroxynaphthalene-6-sulfonic acid | 8 g |
| Zinc chloride | 50 g |
| Thiourea | 50 g |
| Patent Blue | 0.1 g |
| Water | balance |
| Total | 1 liter |

The solution is coated on a base paper and dried in the same manner as in Example 1 to obtain a photosensitive sheet.

A semi-transparent having images formed by a back-carbon-type typewriter is prepared and the surface of one image is treated with the treating material prepared in Example G and the surface of another image is treated with the treating material prepared in Example I. The so prepared original for multicolor reproduction is superposed on the above photosensitive sheet so that the treated surface of the original is in face-to-face contact with the photosensitive layer of the photosensitive sheet. Then, the assembly is exposed to light and heated to form a latent image of the diazonium salt and simultaneously heat-transfer the heat-transferable couplers. Then, the so treated photosensitive sheet is contacted with ammonia-steam to effect the development. Thus, a clear copy is obtained, in which the portion corresponding to the area of the original treated with the treating material of Example G is colored in yellow, the portion corresponding to the area of the original treated with the treating material of Example I is colored in reddish brown and the portion corresponding to the untreated area of the original is colored in blue.

EXAMPLE 6

Multicolor-forming film

A solution of the following recipe is prepared:

| | |
|---|---|
| 4-Diazo-2,5-dibuthoxy-N-phenyl morpholine·½ $ZnCl_2$ | 10 g |
| Citric acid | 8 g |
| β-Hydroxynaphtoic acid ethanol amine | 8 g |
| Triacetate resin | 15 g |
| Oil Blue | 0.2 g |
| Acetone | 700 ml |
| Methanol | 300 ml |

The solution is coated on a polyester film by a rod coater and dried at a relatively low temperature (40° – 50°C.) by warm air to form a photosensitive film.

An original sheet having an image formed by a back-carbon-type typewriter is prepared, and the surface of a part of the image area of the original is treated with the ink-like agent prepared in Example A and the surface of another part of the image area is treated with the treating agent prepared in Example C. The so formed original for multi-color reproduction is superposed on the above photosensitive film so that the treated surface of the original is in face-to-face contact with the photosensitive layer of the photosensitive film. The assembly is exposed to light by a mercury lamp and heated and printed. The photosensitive film containing a latent image of the diazonium salt is developed with gasified ammonium and steam. Thus, a clear reproduction copy is obtained, in which a portion corresponding to the part treated with the treating material of Example A is colored in yellow, a portion corresponding to the part treated with the treating material of Example C is colored in reddish brown, and another portion corresponding to the untreated part of the original is colored in blue.

EXAMPLE 7

Multi-color forming diazo-type photosensitive paper for use in dry development

A solution of the following recipe is prepared:

| | |
|---|---|
| 4-Diazo-N,N-dimethylaniline chloride·½ $ZnCl_2$ | 15 g |
| Glycerine | 50 g |
| Tartaric acid | 40 g |
| Sodium 2,3-dihydroxynaphthalene-3,6-disulfonate | 15 g |
| Zinc chloride | 30 g |
| Thiourea | 50 g |
| Patent Blue | 0.1 g |
| Water | balance |
| Total | 1 liter |

The solution is coated on a base for a photosensitive paper by means of an air knife coater and dried to obtain a photosensitive paper for multi-color reproduction.

Separately, a semi-transparent original having an opaque image is superposed on a conventional diazo-type photosensitive sheet (for yellowish brown coloration) for an intermediate copying sheet so that the image surface of the original is in face-to-face contact with the photosensitive layer of the photosensitive material, and the assembly is exposed to ultraviolet rays emitted from the side of the original and developed with ammonia-steam to form an intermediate copying original. Then, in the so formed original a second image is written on the surface opposite to the image-carrying surface to thereby obtain an original having images on both surfaces. A part of the surface of the image on one surface of the original is treated with the waxy agent prepared in Example I and other part of the surface of the image on the same surface of the original is treated with the treating material of Example G (see FIG. 3) to obtain an original for multi-color reproduction.

The so formed original is superposed on the above photosensitive paper so that the treated surface of the original is in face-to-face contact with the photosensitive layer of the photosensitive paper. Then, the assembly is exposed to light and heat emitted from the side of the original to thereby form a latent image of the diazonium salt and simultaneously accomplish the heat transfer of the heat-transferable couplers. The so treated photosensitive is developed with ammonia-steam. Thus, a three-color copy is obtained, in which the portion corresponding to the part treated with the treating material of Example I is colored reddish brown, the portion corresponding to the part treated with the treating agent of Example G is colored in yellow and the portion corresponding to the untreated part is colored in blue.

EXAMPLE 8

A diazo-type intermediate copying original having images on both surfaces is prepared in the same manner as in Example 7. The back surface of a preselected image area on one surface of the original is treated with the ink-like agent prepared in Example A and the surface of another preselected image area on the same surface is treated with the treating material prepared in Example C (see FIG. 4) to form an original for multi-color reproduction. The so formed original is superposed on a photosensitive paper as prepared in Example 7, in the same manner as in Example 7, and the light exposure, heat transfer and development are carried out in the same manner as in Example 7 to obtain a three-color copy in which the portion corresponding to the area treated with the agent of Example A is colored in yellow, the portion corresponding to the area treated with the agent of Example C is colored in reddish brown and the portion corresponding to the untreated area is colored in blue.

EXAMPLE 9

A diazo-type intermediate copying original having images on both surfaces is prepared in the same manner as in Example 7. The surface of a preselected image area on one surface is treated with the treating agent of Example A and the back surface of a preselected image area on the opposite surface of the original is treated with the treating agent of Example C (see FIG. 2) to obtain an original for multi-color reproduction. In the same manner as in Example 7, the so formed original is superposed on a photosensitive paper prepared by the method described in Example A, and the light exposure, heat transfer and development are carried out in the same manner as in Example 7 to obtain a three-color copy in which the portion corresponding to the area treated with the treating agent of Example A is colored in yellow, the portion corresponding to the area treated with the treating agent of Example C is colored in reddish brown and the portion corresponding to the untreated area is colored in blue.

What we claim is:

1. A process for multi-color reproduction which comprises (A) exposing image-wise a diazo-type photosensitive material to actinic light by exposing through an original sheet of an assembly which consists of (i) a transparent or semi-transparent original sheet having opaque image areas on both surfaces and a layer containing at least one thermovolatile or sublimable azo coupler (a), said layer being on one surface of said original sheet with the proviso that coupler (a) is located in only preselected areas which are image areas on firstly the surface to which the layer of coupler (a) is applied, secondly areas contiguous with the opaque image areas on the opposite surface to which the layer of coupler (a) is applied, or thirdly both at the same time, and (ii) a diazo-type photosensitive material having a photosensitive layer containing at least one photosensitive diazonium salt (c), an acidic stabilizer and an azo coupler (b) having a substantially lower rate of coupling with the diazonium salt (c) under the developing conditions than that of the azo coupler (a), said original sheet (i) being superposed on said diazo-type photosensitive material (ii) so that the layer of the azo coupler (a) comes into face-to-face contact with the photosensitive layer;

(B) heating said assembly to thereby heat-transfer said layer of coupler (a) to the corresponding position on the surface of said photosensitive layer, said steps (A) and (B) being performed simultaneously or in the time sequence of (A) to (B) or (B) to (A); and (C) contacting the exposed photosensitive material with a mixture of ammonia and steam or an alkali-containing aqueous liquid developer to thereby develop said photosensitive material, whereby in the unexposed latent image area of the portion to which the coupler (a) has been heat-transferred, a dye (c)-(a) having a certain hue or color is formed by the selective reaction of the heat-transferred coupler (a) with the diazonium salt (c) and at the same time, in the unexposed latent image areas to which the coupler (a) has not been heat-transferred, a dye (c)-(b) having a different hue or color from said dye (c)-(a) is formed by the reaction of the coupler (b) with the diazonium salt (c), thus producing a multi-colored copied image.

2. The process of claim 1 wherein said coupler (a) is applied in the form of a composition comprising from 5 to 25% by weight of said coupler (a), 0 to 3% by weight of a colorant, 0 to 5% by weight of a binder, 0 to 2% by weight of a dispersant and the balance an organic solvent.

3. The process of claim 1 wherein said coupler (a) is applied in the form of a composition comprising 5 to 25% by weight of the coupler (a), 85 to 15% by weight of a wax, 10 to 40% by weight of an oil and 0 to 20% by weight of a colorant.

4. The process of claim 1 wherein said coupler (a) is on a transparent transfer sheet disposed between said original and said photosensitive sheet.

5. The process of claim 1 wherein said coupler (a) is a compound free of sulphonic acid groups and selected from a phenol compound, a hydroxynaphthalene compound, an aniline compound and a compound containing an active methylene group.

6. A process for multi-color reproduction which comprises (A) exposing image-wise a diazo-type photosensitive material to actinic light by exposing through an original sheet of an assembly which consists of (i) a transparent or semi-transparent original sheet having opaque image areas on both surfaces and a layer containing at least one thermovolatile or sublimable azo coupler (a), said layer being on one surface of said original sheet, and the proviso that coupler (a) is located in only preselected areas which are the image areas on firstly the surface to which the layer of coupler (a) is applied, secondly areas contiguous with the opaque image areas on the opposite surface to which the layer of coupler (a) is applied, or thirdly both at the same time, and (ii) a diazo-type photosensitive material having a photosensitive layer containing at least one photosensitive diazonium salt (c), said original sheet (i) being superposed on said diazo-type photosensitive material (ii) so that the layer of the azo coupler (a) comes into face-to-face contact with the photosensitive layer;

(B) heating said assembly to thereby heat-transfer said layer of coupler (a) to the corresponding position on the surface of said photosensitive layer, said steps (A) and (B) being performed simultaneously or in the time sequence of (A) to (B) or (B) to (A); and (C) thereafter developing the exposed photosensitive layer with an alkaline aqueous liquid developer containing a coupler (b), wherein said coupler (a) has a higher coupling rate under developing conditions than said coupler (b), whereby in the unexposed latent image area of the portion to which the coupler (a) has been heat-transferred, a dye (c)-(a) having a certain hue or color is formed by the selective reaction of the heat-transferred coupler (a) with the diazonium salt (c) and at the same time, in the unexposed latent image areas to which the coupler (a) has not been heat-transferred, a dye (c)-(b) having a different hue or color from said dye (c)-(a) is formed by the reaction of the coupler (b) with the diazonium salt (c), thus producing a multicolored copied image.

7. The process of claim 6 wherein the coupler (a) is applied in the form of a composition comprising from 5 to 25% by weight of the coupler (a), 0 to 3% by weight of a colorant, 0 to 5% by weight of a binder, 0 to 2% by weight of a dispersant and the balance an organic solvent.

8. The process of claim 6 wherein the coupler (a) is applied in the form of a composition comprising 5 to 25% by weight of the coupler (a), 85 to 15% by weight of a wax, 10 to 40% by weight of an oil and 0 to 20% by weight of a colorant.

9. The process of claim 6 wherein said coupler (a) is a compound free of sulphonic acid groups and selected from a phenol compound, a hydroxynaphthalene compound, an aniline compound and a compound containing an active methylene group.

* * * * *

UNITED STATES PATENT AND TRADEMARK OFFICE

CERTIFICATE OF CORRECTION

PATENT NO. : 3,948,661

DATED : April 6, 1976

INVENTOR(S) : NIHYAKUMEN, ET AL.

It is certified that error appears in the above-identified patent and that said Letters Patent are hereby corrected as shown below:

Please insert the Foreign Application Priority Data as follows:

| | | |
|---|---|---|
| -- February 19, 1969 | JAPAN | 44-11914 |
| August 22, 1969 | JAPAN | 44-65980 |
| November 11, 1969 | JAPAN | 44-91964 -- |

Claim 6, line 10, delete "and", insert -- with --

Signed and Sealed this

Third Day of August 1976

[SEAL]

*Attest:*

RUTH C. MASON
*Attesting Officer*

C. MARSHALL DANN
*Commissioner of Patents and Trademarks*